US012523029B2

(12) United States Patent
Hennessy

(10) Patent No.: US 12,523,029 B2
(45) Date of Patent: Jan. 13, 2026

(54) SYSTEM AND METHOD FOR FLUSHING AN OBJECT

(71) Applicant: P & C Hennessy Holdings, Inc., Frankford (CA)

(72) Inventor: Philip Dawson Hennessy, Frankford (CA)

(73) Assignee: P & C Hennessy Holdings, Inc, Frankford (CA)

( * ) Notice: Subject to any disclaimer, the term of this patent is extended or adjusted under 35 U.S.C. 154(b) by 82 days.

(21) Appl. No.: 18/529,934

(22) Filed: Dec. 5, 2023

(65) Prior Publication Data

US 2024/0191484 A1 Jun. 13, 2024

Related U.S. Application Data

(60) Provisional application No. 63/386,388, filed on Dec. 7, 2022.

(51) Int. Cl.
*E03D 1/08* (2006.01)
*E03D 1/22* (2006.01)

(52) U.S. Cl.
CPC ..... *E03D 1/08* (2013.01); *E03D 1/22* (2013.01)

(58) Field of Classification Search
CPC ..... E03D 1/08
See application file for complete search history.

(56) References Cited

U.S. PATENT DOCUMENTS

2001/0034903 A1* 11/2001 Martin ..... E03D 3/10 4/354
2022/0064923 A1* 3/2022 Tone ..... E03D 1/30

* cited by examiner

*Primary Examiner* — Christine J Skubinna
(74) *Attorney, Agent, or Firm* — Bradley Arant Boult Cummings LLP; Henry B. Ward, III

(57) ABSTRACT

Flush systems for flushing an object and flush toilets are disclosed. The flush system includes a first enclosed container for storing liquid to flush the object; a second container for filling liquid from a source; and a third enclosed container at least partially below each of the first enclosed container and the second container, the third enclosed container configured to contain liquid and gas and to be in fluid communication with each of the first enclosed container and the second container, and the first enclosed container and the second container configured to be in liquid communication via the third enclosed container. The gas in the third enclosed container is configured to exert a head pressure, via one or more conduits, to the liquid in the first enclosed container to flush the object.

20 Claims, 10 Drawing Sheets

SYSTEM AND METHOD FOR FLUSHING AN OBJECT

CROSS-REFERENCE TO RELATED APPLICATIONS

The present application claim priority over the U.S. provisional application No. 63/386,388, entitled "HIGH HEAD PRESSURE LOW PROFILE WATER SAVING TOILET", filed on Dec. 7, 2022, which is incorporated in this disclosure in its entirety.

FIELD OF THE INVENTION

Example embodiments relate to flushing objects, in particular, to systems and methods for flushing an object.

BACKGROUND OF THE INVENTION

A high performance, low volume and low profile toilet is desired. With current low profile volume toilets there exists a corresponding reduction in the performance and flushing capabilities of the toilet due to the limited amount of head pressure that can be generated in a reduced height tank. With the market moving towards the use of lower water volume fixtures current low-profile fixtures are unable to generate enough head pressure to perform adequately at a reduced volume. Therefore, a toilet that could generate a sufficient amount of head pressure in a low-profile tank would be of considerable value in the market.

Currently low-profile toilets are sold as designer grade pieces, but are unable to flush effectively on low volumes of water, which has become the status quo in the market today as it is desired to conserve water.

The current existing high performance, low volume toilet requires a toilet tank which provides head pressure of approximately 8" above the toilet bowl rim, making it impossible to incorporate the current flush systems into a low-profile toilet.

BRIEF SUMMARY OF THE INVENTION

The present disclosure provides a completely self-contained flush system whereby a low-profile toilet creates a high head pressure, which allows for improved performance at a low water volume and which is not dependent on the incoming water pressure, and the resulting flush is quiet and consistent.

The present disclosure allows for greater head pressure, such as approximately two (2) times the head pressure attained at 8" of head pressure, at a greatly reduced height above the toilet rim. This allows the flush system to be housed within a low-profile toilet, which provides for more widespread use and available design options for a high performance, low volume toilet.

Furthermore, because a toilet fixture would be able to house the improved flush system disclosed herein within a low profile (reduced height tank) more design capabilities are available to toilet manufactures.

The flush system in the present disclosure comprises an upper enclosed container that houses a flush valve that is connected to a lower container through a conduit (air transfer tube). Prior to a flush, the fill valve turns on to transfer water into the first upper enclosed container, the lower container is already filled with water and is connected through a series of vertical conduits to a second upper container which is open to the atmosphere and houses the fill valve. As water fills the first upper container from the fill valve, air is displaced or transferred to the lower container through the conduit. This transferred air displaces water from the lower container up the vertical conduit(s). Due to the transfer of air, a force (head pressure) is exerted on the water in the first upper container through the conduit connected to the lower container. Therefore, this improved flush system is able to flush a toilet with a relatively low height tank, but achieve a relatively high head pressure, which in turn increases performance of the flush system and allows the flush water volume to be reduced, and the resulting flush is quiet and consistent.

Furthermore, because the self-contained flush system is not dependent on the water pressure entering the system to function, the resulting flush will be quiet, unlike pressure-assisted systems currently sold in the market. Also, as there are no moving parts (works on the principles of transferring air and water between the containers) beyond the typical fill and flush valves, the flush system requires little maintenance, resulting in a reliable, consistent and powerful flush each and every time.

In an aspect, there is provided a flush system for flushing an object, comprising: a first enclosed container for storing liquid to flush the object; a second container for filling liquid from a source; and a third enclosed container at least partially below each of the first enclosed container and the second container, the third enclosed container configured to contain liquid and gas and to be in fluid communication with each of the first enclosed container and the second container, and the first enclosed container and the second container configured to be in liquid communication via the third enclosed container, wherein the gas in the third enclosed container is configured to exert a head pressure, via one or more conduits, to the liquid in the first enclosed container to flush the object.

The flush system in any one of the preceding aspects, the object is a toilet bowl.

The flush system in any one of the preceding aspects, the second container is at least partially open to atmosphere.

The flush system in any one of the preceding aspects, the second container is enclosed.

The flush system in any one of the preceding aspects, a bottom surface of the first enclosed container or the second container is higher than a top surface of the third enclosed container.

The flush system in any one of the preceding aspects, the first enclosed container is placed substantially at a same level as a top rim of the toilet bowl.

The flush system in any one of the preceding aspects, the head pressure is generated from the atmosphere and the liquid in the second container.

The flush system in any one of the preceding aspects, the gas in the third enclosed container exerts the head pressure to the liquid in the first enclosed container via one or more conduits.

The flush system in any one of the preceding aspects, the second container is in fluid communication with the third enclosed container via one or more conduits.

The flush system in any one of the preceding aspects, the first enclosed container comprises a flush valve.

The flush system in any one of the preceding aspects, the head pressure is generated from compressed gas injected into the third enclosed container and the liquid in the second container.

The flush system in any one of the preceding aspects, the first enclosed container is in fluid communication with the third enclosed container via one or more conduits, the one or more conduits comprising a check valve configured to selectively open or close the fluid communication.

The flush system in any one of the preceding aspects, the third enclosed container is configured to inject compressed gas in the first enclosed container via one or more conduits.

The flush system in any one of the preceding aspects further comprises a gas valve on the one or more conduits for selectively open and close gas injection to the first enclosed container from the third enclosed container.

The flush system in any one of the preceding aspects, the liquid is water, and the gas is air from the atmosphere.

The flush system in any one of the preceding aspects, a top surface of the second container and a top surface of the first enclosed container are above a top surface of the third enclosed container, for example, approximately 15 to 18 inches.

The flush system in any one of the preceding aspects, the flush system is in a stand-by mode, a flush mode, or a fill mode.

In another aspect, there is provided a toilet system, comprising: a toilet bowl; a first enclosed container in fluid communication with the toilet bowl, the first enclosed container configured for storing liquid to flush the toilet bowl; a second containers configured for receiving liquid from a source; and a third enclosed container at least partially below each of the first enclosed container and the second container, the third enclosed container configured to contain liquid and gas, and to be in fluid communication with each of the first enclosed container and the second container, and the first enclosed container and the second container configured to be in liquid communication via the third enclosed container, wherein the gas in the third enclosed container is configured to exert a head pressure, via one or more conduits, to the liquid in the first enclosed container to flush the toilet bowl.

The toilet system in any one of the preceding aspects, the first enclosed container is placed substantially at a same level as a top rim of the toilet bowl.

In another aspect, there is provided a method for flushing a toilet bowl, comprising: storing liquid to flush the toilet bowl in a first enclosed container in fluid communication with the toilet bowl; receiving liquid from a source in a second containers; and exerting a head pressure to gas store in a third enclosed container, via one or more conduits, to the liquid in the first enclosed container to flush the toilet bowl, wherein the third enclosed container configured to contain liquid and gas, and to be in fluid communication with each of the first enclosed container and the second container, and the first enclosed container and the second container configured to be in liquid communication via the third enclosed container.

BRIEF DESCRIPTION OF THE SEVERAL VIEWS OF THE DRAWINGS

Reference will now be made, by way of example, to the accompanying drawings which show example embodiments of the present application, and in which.

Similar reference numerals may have been used in different figures to denote similar components.

DETAILED DESCRIPTION OF THE INVENTION

Figure 1:
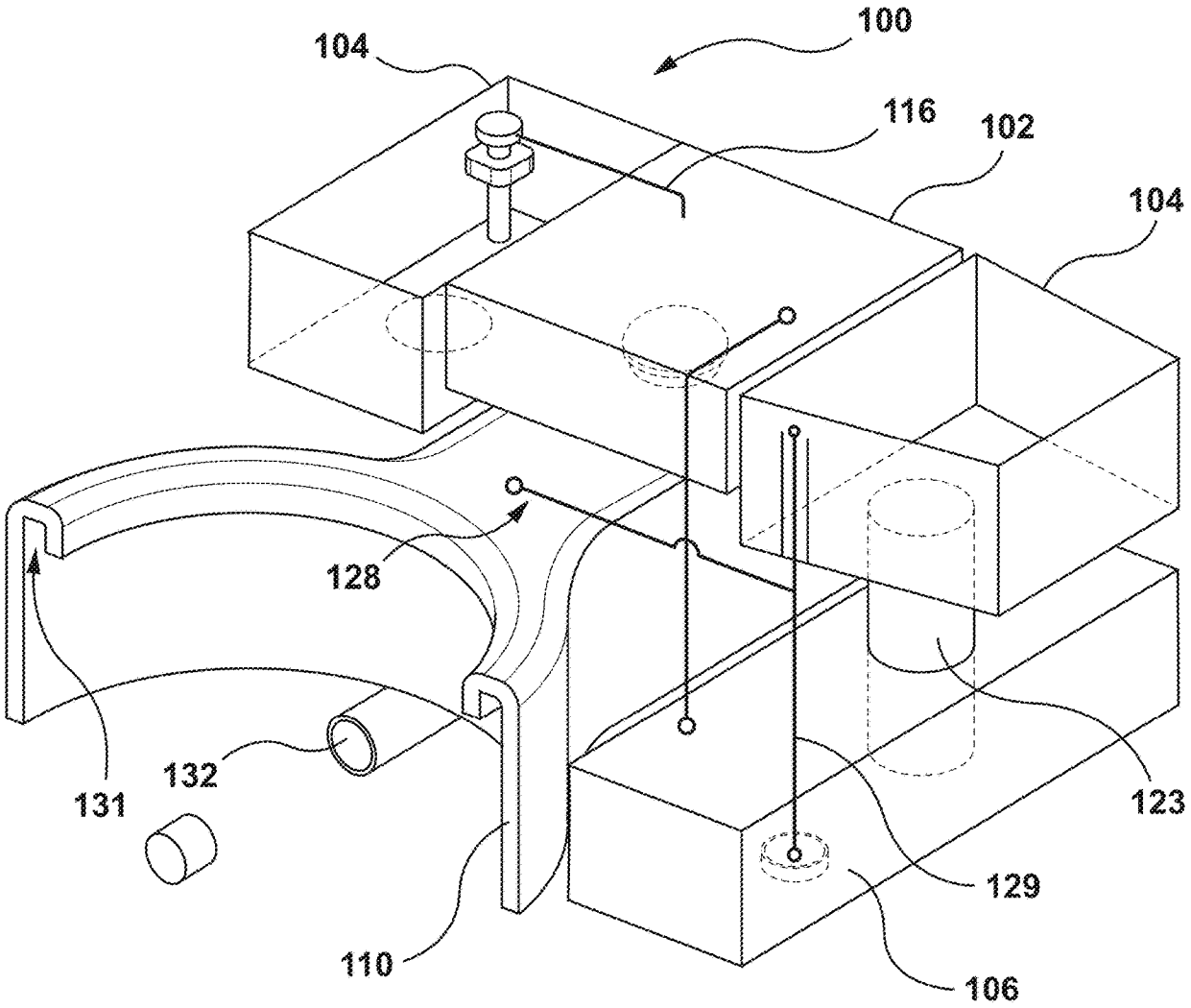
FIG. 1 is a partial front perspective view of a flush system, according to an embodiment of the present disclosure.
Figure 2:
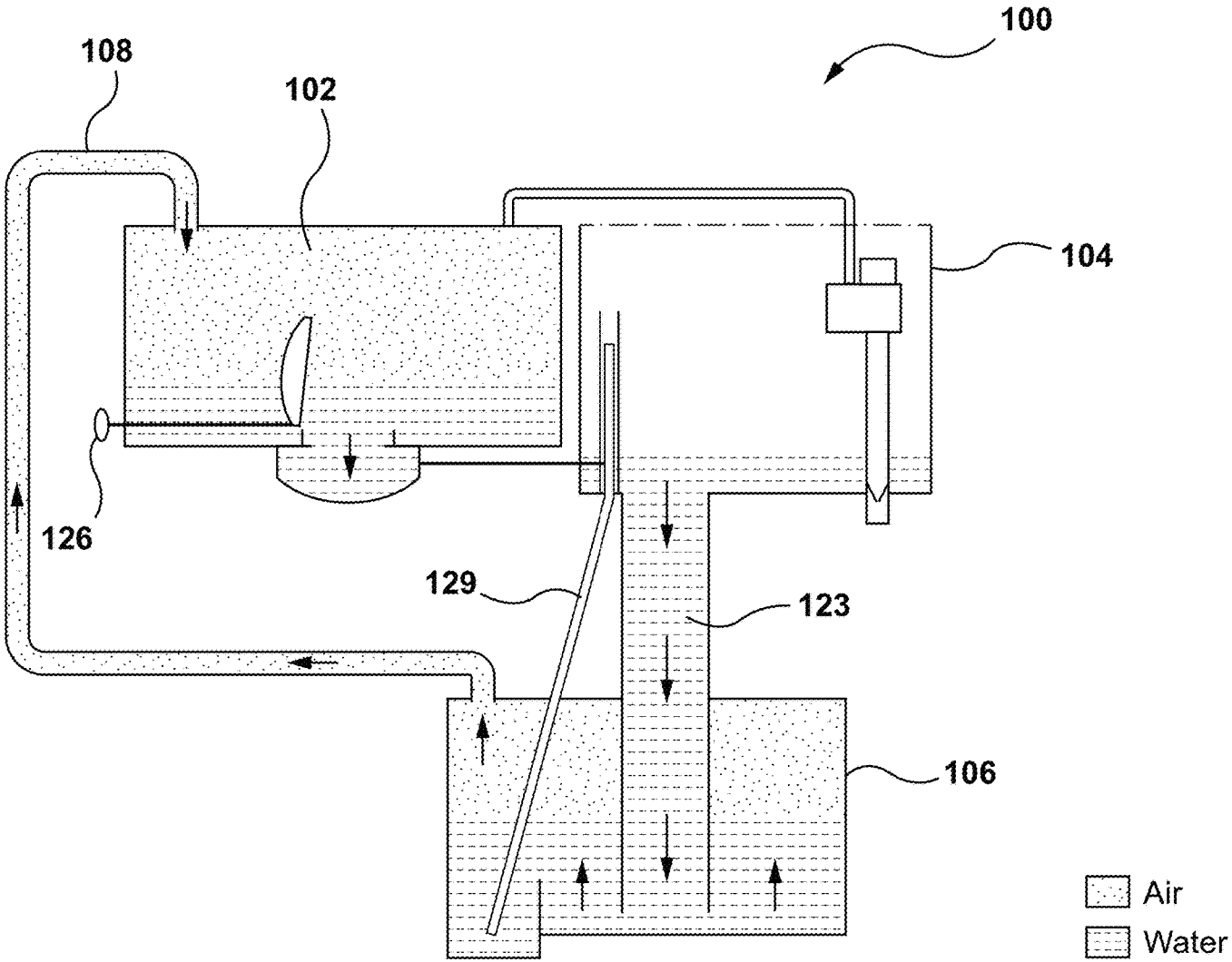
FIG. 2 is a cross-sectional view of the flush system in FIG. 1.
Figure 3:
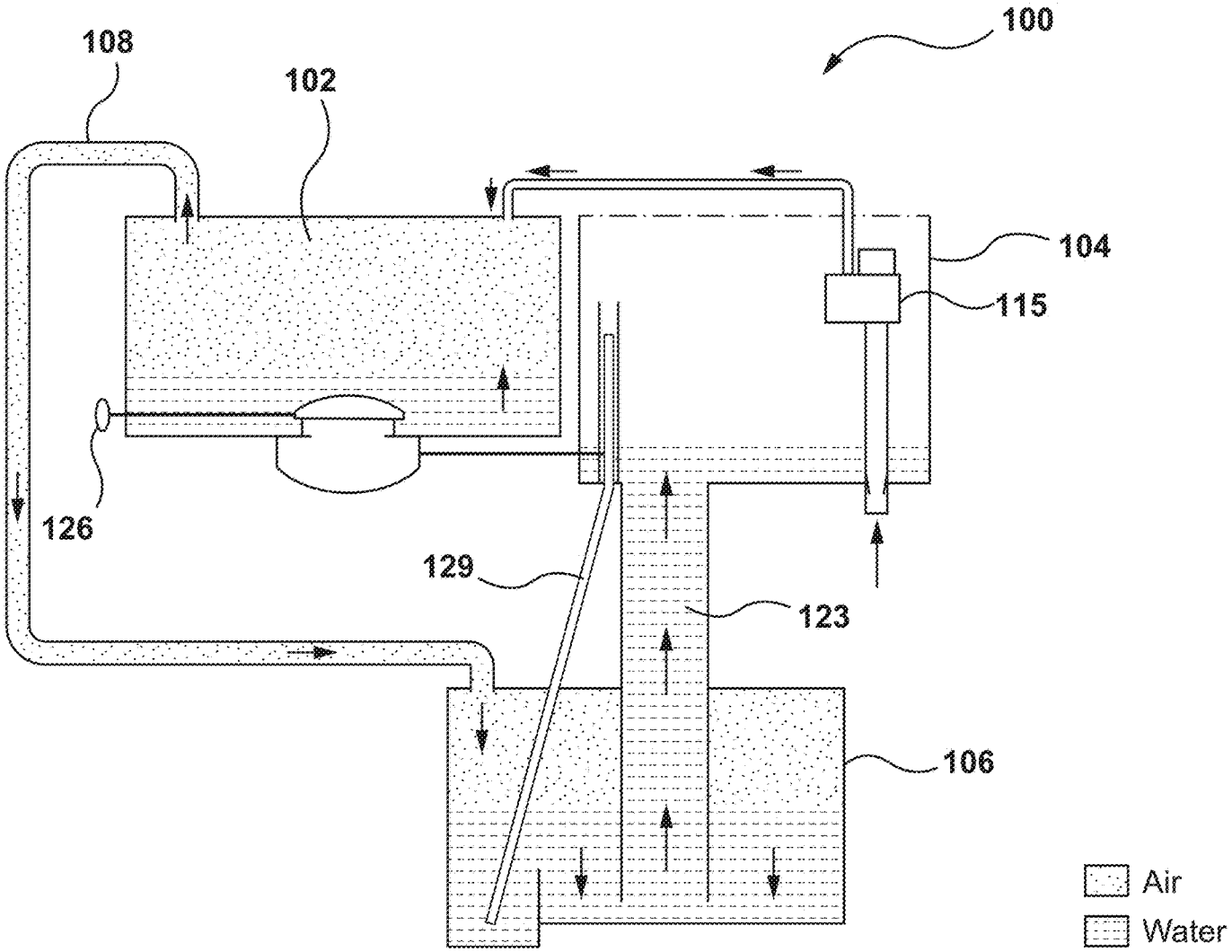
FIG. 3 is a cross-sectional view of the flush system in FIG. 1.

FIGS. 1-8 illustrate exemplary embodiments of flush systems 100 and 200. The flush systems 100 and 200 may include a first enclosed container 102 or 202 for storing water to flush the toilet; a second containers 104 or 204 for filling water from a water source; and a third enclosed container 106 or 206 at least partially below each of the first enclosed container 102 or 202 and the second container 104 or 204. The third enclosed container 106 or 206 is configured to contain liquid, such as water, and gas, such as air. The second enclosed container 104 or 204 are configured to be in fluid communication with each of the first enclosed container 102 or 202 and second container 104 or 204, for example via one or more conduits.

In the exemplary embodiments of flush systems 100 and 200, the water in the second container 104 or 204 is configured to exert a pressure on the gas in the third enclosed container 106 or 206. When the first enclosed container 102 or 202 is actuated to discharge water stored therein, the gas in the third enclosed container 106 or 206 exerts a head pressure, via one or more conduits 108 or 208, to the water in the first enclosed container 102 or 202 to flush a toilet bowl 110. The head pressure increases the velocity of the water forced out of the first enclosed container 202 into the toilet bowl 110, resulting in an improved toilet flush performance with a reduced volume of water used. The systems 100 and 200 are not dependent on the incoming water pressure and the flush is quiet and consistent. The toilet bowl 110 may also be any other selected object to be flushed.

In the present disclosure, the fluid may include water or air; water can also be any other liquid and the air can be any other gas. The terms are used interchangeably in the present disclosure.

The flush system 100 in the embodiment illustrated in the example of FIGS. 1-4 may include a first enclosed container 102, a second container 104, and a third enclosed container 106.

The first enclosed container 102 is configured to store water for flushing an object, such as a toilet bowl. The first enclosed container 102 is in fluid communication with the second enclosed container 104 via the third enclosed container 106. The water is supplied to the first enclosed container 102 from the fill valve 115 held within the second container 104 via a conduit 116. The first enclosed container 102 may also include a conduit 128, for example, close to but above the bottom surface 102*b*, to provide fluid communication with a rim channel 131 of a toilet bowl 110.

The first enclosed container 102 may house an actuator or a flush valve 114. When the flush valve 114 is triggered, the water stored in the first enclosed container 102 is discharged to flush an object, such as the toilet bowl 110.

In the embodiment of the flush system 100, the second container 104 is open to the atmosphere. The second container 104 may house a fill valve 115 for filling water, from a water source such as a water pipe, into the second container 104. The fill valve 115 may be mounted at any other position of the flush system 100. The fill valve 115 is configured to connect to the first enclosed container 102 through one or more conduits 116 so that the water is also filled into the first enclosed container 102 via the conduit 116 to a desired level, such as substantially the full volume of the first enclosed container 102. By filling the water in the first enclosed container 102, the air within the first enclosed container 102 is displaced with water and is forced into the third enclosed container 106 through one or more conduits 108.

In the embodiment of the flush system 100, the first enclosed container 102 connects to the third enclosed container 106 via one or more conduits 108 to provide fluid communication, such as gas or air, between the third enclosed container 106 and the first enclosed container 102. In the example of FIGS. 1-4, one end of the conduit 108 connects to the top surface 106*b* of the third enclosed container 106, and the other end of the conduit 108 connects to the top surface 102*a* of the first enclosed container 102.

The second container 104 is configured to be open to the atmosphere. As such, the atmosphere exerts a pressure P0 to the water in the second container 104.

The second container 104 is in fluid communication with the third enclosed container 106 via one or more conduits 123. The conduit 123 extends into the third enclosed container 106 from the bottom surface 104*a* of the second enclosed container 104. In the example of FIGS. 1-4, the conduit 123 extends into the third enclosed container 106 close to the bottom surface 106*a* of the third enclosed container 106. —To ensure gas does not escape from container 106 during the filling phase, the conduit 123 has an opening that extends below 106*c* but above the bottom surface 106*a* of the third enclosed container 106.

The third enclosed container 106 contains both water and air. In some examples, the amount of gas or air displaced between containers 106 and 102 are substantially equal and therefore operate at a 1:1 ratio. Due to the lower density of air, the air is above the water surface 106*c* in the third enclosed container 106.

In another example, the second container 104 may include two or more containers open to the atmosphere and in fluid communication, as illustrated in the example of FIG. 1. Each of the two or more containers may be in fluid communication with the third enclosed container 106 via one or more separate conduits.

The top surface 106*b* of the third enclosed container 106 may be lower than the bottom surface 104*a* of the second container 104. In the example of FIGS. 1-4, the top surface 106*b* of the third enclosed container 106 is lower than the bottom surface 104*a* of the second container 104 by a height of h. As such, water in the second container 104 and the open air, which has a pressure P0, exert a pressure to the water and air in the third enclosed container 106 via the conduit 123. For example, the height between the top surface water level 104*c* in the second container 104 and the water at the top surface 106*c* of the third enclosed container 106 is H, the head pressure exerted on the air at the top surface 106*b* of the third enclosed the is $P=P0+\rho Hg$, where: P is the pressure at the top surface 106*b*; P0 is the pressure of the atmosphere; $\rho$ is the density of the water; g is the acceleration due to gravity; and H is the height between the top surface 104*c* of the water held in the second container 104 and the top surface 106*c* of the water held in the third enclosed container 106. Therefore, the configuration of the second container 104 and third enclosed container 106 creates additional pressure to the air in the third enclosed container 106 via the water in the conduit 123.

As such, the amount of head pressure P applied to the water in the first enclosed container 102 depends on the height between the water level in the second container 104 and the pressure of air held in the third enclosed container 106. The head pressure P exerted on the water held in the first enclosed container 102 is related to the height between the top surface 104*c* of the water held in the second container 104 and the top surface 106*c* of the water held in the third enclosed container 106 and to the open air pressure.

In some examples, the top surface 104*b* of the second container and the top surface 102*a* of the first enclosed container 102 are substantially at the same height and located approximately 15 to 18 inches above the bottom surface 106*a* of the third enclosed container.

In some examples, the head pressure is at a height equal to at least about 15 inches or more above the toilet bowl rim channel 131 before flushing, and the head pressure decreases as the toilet flushes.

In some examples, the water filled in the second container 104 has at least the same or higher volume as the volume of the air trapped in the third enclosed container 106, so that when the first enclosed container 102 is filled with water and forcing substantially all the air out and into the third enclosed container 106 during the fill phase, the second container 104 receives the replaced water from the third enclosed container 106. The volume of the air retained in the third enclosed container 106 has at least the same volume as the water in the first enclosed container 102, so that the water in the first enclosed container 102 may be substantially forced out and replaced by the air from the third enclosed container 106 to flush the object, such as a toilet bowl 110.

By virtue of the conduit 108, the air in the third enclosed container 106 in turn exerts the head pressure P on the water or air in the first enclosed container 102. The bottom surface 102*a* of the first enclosed container 102 may be higher than the top surface 106*b* of the third enclosed container 106.

Upon opening the flush valve 114, for example by pulling a handle or pressing a button 126 mounted on the first enclosed container 102, as described above, the water stored in the second container 104, together with pressure of the atmosphere, exerts a head pressure P to the air in the third enclosed container 106. The handle or button 126 may also be mounted on the second container 104. The pressurized air trapped in the third enclosed container 106 transfers the pressure, via the conduit 108, to the water stored in the first enclosed container 102, and the pressured air from third enclosed container 106 forces the water stored in the first enclosed container 102 to move to the object through the conduit 128, such as to the jet and rim channels 131 of the toilet bowl 110, displacing the contents of the toilet bowl 110 into the trapway 132 while generating a strong siphon.

The head pressure created from the displacement of pressurized air from the third enclosed container 106 into the first enclosed container 102 increases the velocity of the water forced out of the first enclosed container 102 into the toilet bowl 110, resulting in an improved toilet flushing performance with a reduced volume of water, and the flush is quiet and consistent.

After the water in the first enclosed container 102 is discharged to flush the object, the flush valve 114 is configured to be closed, for example by a biasing force of a spring, and the fill valve 115 is configured to open to automatically refill the water in the enclosed container 102 and the second container 104. During the refilling process, as the water level increases in the first enclosed container 102, the air within the first enclosed container 102 is displaced with water and is forced into the third enclosed container 106 through the conduit 108. The air from the conduit 108 forces the water in the third enclosed container 106 up to the second container 104 via the conduit 123.

The water displaced from the third enclosed container 106 stays in the second container 104 until the next time the toilet is flushed by activating the handle 126 by a user to open the flush valve 114.

Figure 4:
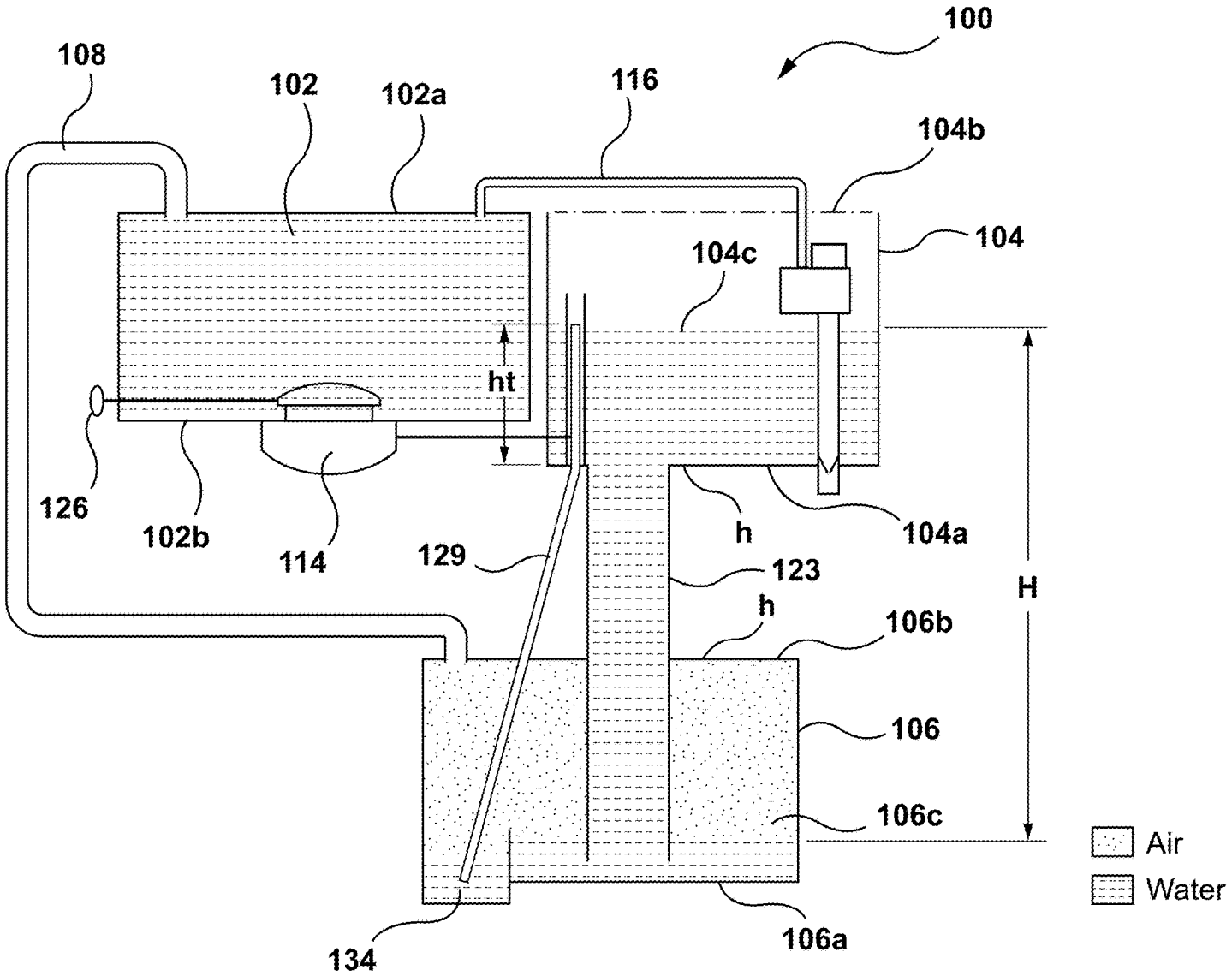
FIG. 4 is a cross-sectional view of the flush system in FIG. 1.

In the example of FIG. 4, when the flush system 100 is used in a toilet system, the flush system 100 may include a refill tube 129 with a first end positioned above the bottom surface 106*a* of the third enclosed container 106, and a second end connected to a toilet bowl rim channel 131 through conduit 128 at a predetermined height $h_r$. The height of the refill tube 129 is adjustable and based on the amount of water required. The amount of water required is dependent on the flush volume desired. For example, more refill is required for a 4.0 L toilet compared to a 3.0 L toilet. During the refill process, due to the pressure created by the air flow from the first enclosed container 102, a portion of the water within the third enclosed container 106 may be driven to travel up via the conduit 123 to the second container 104. The water level in the second container 104 and the refill tube 129 rises at the same rate and maintains the same level until a height $h_r$ is reached where the water will overflow the refill tube 129 to the toilet bowl 110. The overflow water then transfers through conduit 128 and enters the toilet bowl rim channel 131. The overflow water refills the toilet bowl 110 to create a seal, such as a 50 mm seal. The water ceases overflowing the refill tube 129 when the water level in the third enclosed container 106 reaches a predetermined height or level of the divider 134. The height of the divider 134 is adjustable and based on the amount of refill water required. The quantity of refill water can be increased or decreased by adjusting the elevation of the refill tube 129 or elevation of the divider 134.

The refill tube 129 allows the system 100 to provide a source of refill water and enables the system 100 to exchange a portion of the water held in the third enclosed container 106 with fresh water during each flush cycle to prevent water stored in the third enclosed container 106 from becoming stagnate.

A quantity of water equal to the quantity of water that flows through the refill tube 129 to the toilet bowl 110 for refill transfers from the water rising from the second third container 106 prior to the completion of the refill process and fill valve 115 being shut off.

When the refill is completed, the head pressure H is formed again on the air trapped in the third enclosed container 106, and exerts on the water in the first enclosed container 102 through the conduit 108.

In some examples, the system 100 may include a backflow preventer (not shown) to prevent water from flowing back into the fill valve 115, when the water creating the head pressure is below the surface of the water in the container 104. Because the water in the container 104 is below the level of the fill valve 115, the water in the fill valve 115 cannot backflow into the water supply and cross contaminate any drinking water. The backflow preventer may also be mounted inside the conduit 116 as a secondary way to prevent water flowing back into the fill valve 115.

With the configuration of the flush system 100, due to the head pressure H created by the second container 104 and the third enclosed container 106, the first enclosed container 102 may be mounted at the substantially the same height as the toilet bowl 110 while generating sufficient pressure on the water to flush the toilet bowl 110 with improved flush performance, and the resulting flush is quiet and consistent. For example, the top surface 102*a* of the first enclosed container 102 has substantially the same height as the top surface of the toilet bowl 110. Accordingly, the toilet system mounted with the flush system 100 may have a low profile or tankless toilet system.

The volume of first enclosed containers 102 and 202 can be close or equal to the desired flush volume of the toilet. Therefore, to flush 4.0 L of water, the enclosed first containers 102/202 can be sized to hold approximately 4.0 L of either water or air. The volume may be slightly larger than 4.0 L due to the fact it may not be possible to flush out all the contents—some water enviably remains when the flush valve 115 closes. The third enclosed containers 106 and 206 may be sized accordingly and can be larger than the desired flush volume. The first enclosed container 102 is configured to be able to hold the amount of air displaced from first enclosed container 102, plus the quantity of water within necessary to build the head pressure in the system 100 or 200. Similarly, the third enclosed container 206 is configured to be large enough to house a volume of air that is greater than the volume of first enclosed container 202, as well as the water necessary to generate and apply head pressure during the flush. The second containers 104 and 204 are configured to be larger than in volume or capacity, to ensure the second containers 104 and 204 can hold the displaced water from the third enclosed containers 106 and 206 and not overflow. In order to retain head pressure throughout the flush cycle, the configuration of system 100 allows the head pressure to remain exerted on the water in the first container 102 even at the end of the flush, and to ensure the water continues to flow at an increased rate and force to the rim of the bowl. In some examples, the system 100 is configured to remain up to or more than 5" of water column pressure between top surface water level 104*c* at the second container 104 and top surface water level 106*c* at the third enclosed container at the end of the flush.

FIGS. 5-8 illustrate another embodiment of a flush system 200. The flush system 200 may include a first enclosed container 202, a second container 204, and a third enclosed container 206.

The first enclosed container 202 is configured to store water for flushing an object, such as a toilet bowl. The first enclosed container 202 is in fluid communication with the second container 204 via the third enclosed container 206. The water is supplied to the first enclosed container 202 from the second container 204 via the third enclosed container 206, for example, through two or more conduits. The first enclosed container 202 may also include one or more conduits 202*a*, for example, close to but above the bottom surface 202*b*, to provide fluid communication with a rim channel 131 of a toilet bowl 110.

Similar to the second container 104, the second container 204-204 is also open to the atmosphere. The second container 204 may house a fill valve 215 for filling water into the second container 204. The fill valve 215 may connect to a water supply 217 which may connect to a water pipe for supplying water to the water supply 217.

The second container 204 is in fluid communication with the third enclosed container 206 via one more conduits 221. The conduit 221 extends into the third enclosed container 206 from the top surface 204*a* close to but above the bottom surface 206*b* of the third enclosed container 206. Similar to the system 100, to ensure the gas does not escape from the third enclosed container 206, during the filling phase, the conduit 221 has an opening that extends below top surface water level 206*c* but above the bottom surface 206*b* of the third enclosed container 206.

The third enclosed container 206 is configured to retain a mix of gas, such as air, and liquid, such as water. The third enclosed container 206 may also include one or more conduits 226 to receive compressed gas, such as compressed air, in the third enclosed container 206. The conduit 226 may receive compressed gas from a gas or air pump (not shown). The conduit 226 and the fill valve 215 may share a common inlet 219 for selectively injecting water via the conduit 217 to the fill valve 215, or injecting compressed gas or air into the third enclosed container 206 via the conduits 217 and 226. The compressed gas or air may be in a pressure range of 0 pound per square inch (psi) to 1 psi. The air supplied may also be at atmospheric pressure. When the gas or air is compressed to raise the water up via the conduit 221, the amount of pressure exerted is equal to the distance the water rises in the second container 204. This pressure increases as the water fills the second container 204. The difference in water height between top water levels 204*b* and 206*c* starts at approximately 5" or water column and builds until the fill cycle is complete, which is around 15" to 18" of water column, and between approximately 0 and 0.5 PSI and will not exceed 1 PSI. The third enclosed container 206 contains both water and air. The water/gas ratio varies as the toilet moves through different stages—fill, flush and standby model. For example, at standby model, the third enclosed container 206 is approximately 90% air and at the end of the flush is 90% water—is every mix in between these numbers depending on the phase of the toilet system 200. Due to the lower density of gas or air, the air is above the water level in the third enclosed container 206.

In the example of FIGS. 5-8, the top surface 206*a* of the third enclosed container 206 may be configured to be lower than the bottom surface 204*a* of the second container 204. As such, water in the second container 204 exerts a pressure to the water and gas in the third enclosed container 206 via the conduit 221. For example, the height between the top surface water level 204*b* and the water at the water surface 206*c* of the third enclosed container 206 is $H_2$, the pressure of the gas in the third enclosed container 206 is P1. the head pressure P2 exerted on the gas at the water surface 206*c* of the water in the third enclosed container 206 is $P2=P1+\rho H_2 g$, where P is the pressure at the top surface 206*b* of the water in the third enclosed container 206, P1 is the pressure of the compressed gas, ρ is the density of the water, g is the acceleration due to gravity, and $H_2$ is the height between the top surface water level 204*c* at the second container 204 and the top surface water level 206*c* of the third enclosed container 206. Therefore, the configuration of the containers 202, 204 and enclosed containers 206 in flush system 200 creates additional pressure to the water in the third enclosed container 206.

In some examples, the top surface 204*b* of the second container 204 and the top surface 202*a* of the first enclosed container 202 are substantially at the same height and located approximately 15 to 18 inches above the surface water level 206*c* of the third enclosed container.

In the example of FIGS. 5-8, the first enclosed container 202 is in fluid communication with the third enclosed container 206, via one or more conduits 223. The conduit 223 extends into the third enclosed container 206 from the bottom surface 202*b* of the first enclosed container 202. In the example of FIGS. 5-8, the conduit 223 extends into the third enclosed container 206 close to the bottom surface 206*b* of the third enclosed container 206. The conduit 223 has an opening that extends below top surface water level 206*c* but above the bottom surface 206*b* of the third enclosed container 206.

Figure 5:
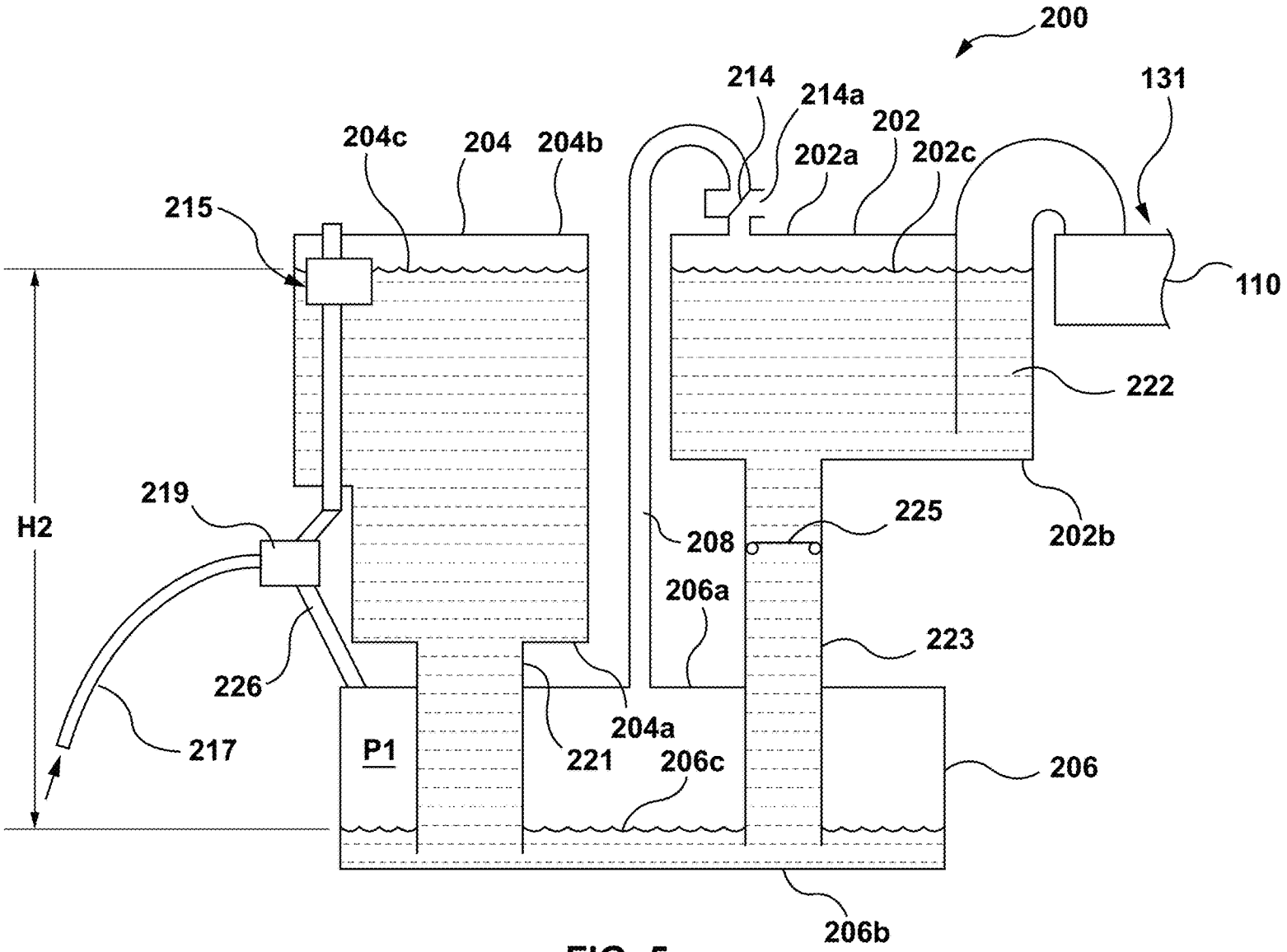
FIG. 5 is a cross-sectional view of a flush system, according to another embodiment of the present disclosure.
Figure 6:
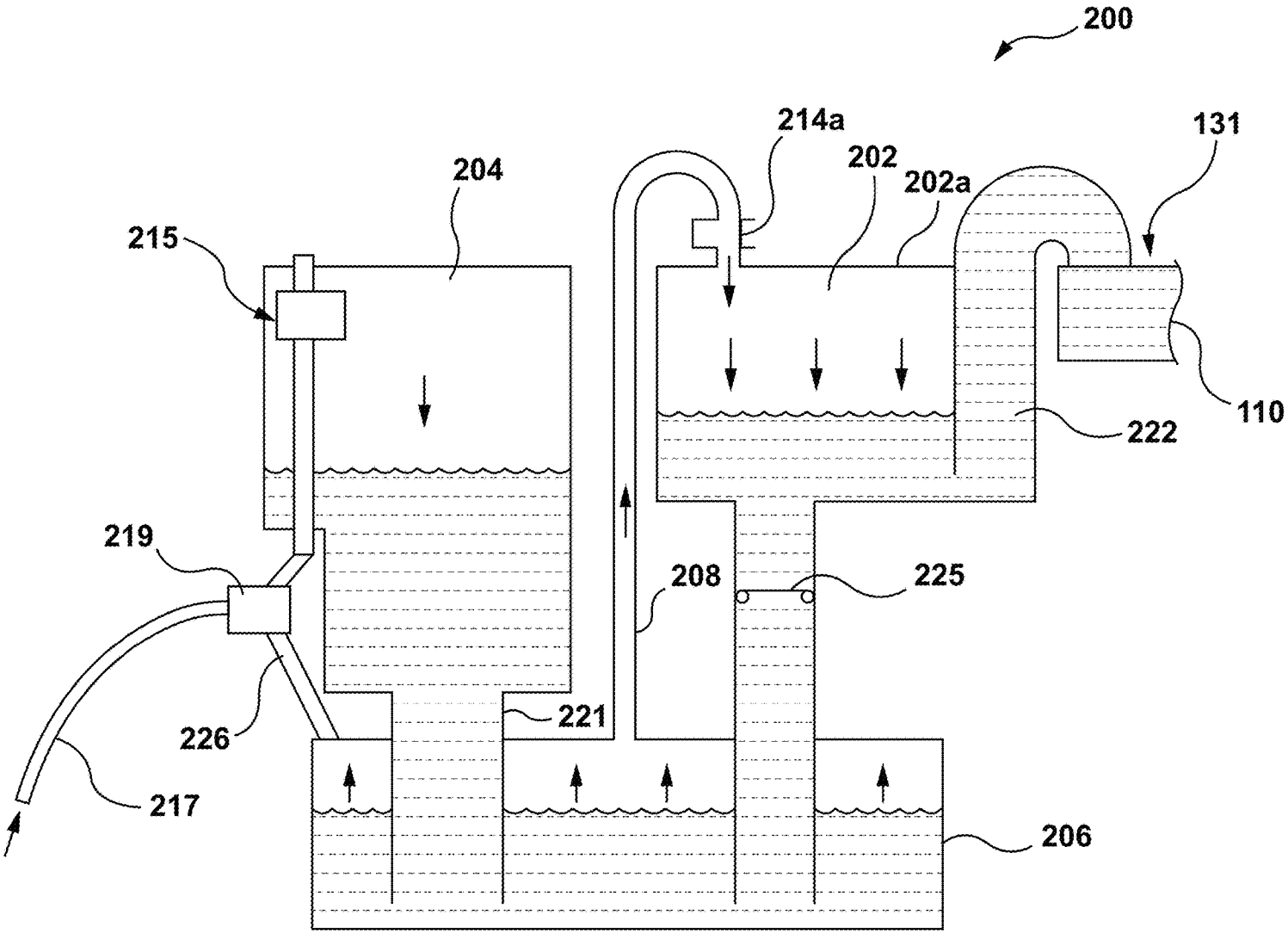
FIG. 6 is a cross-sectional view of the flush system in FIG. 5.
Figure 7:
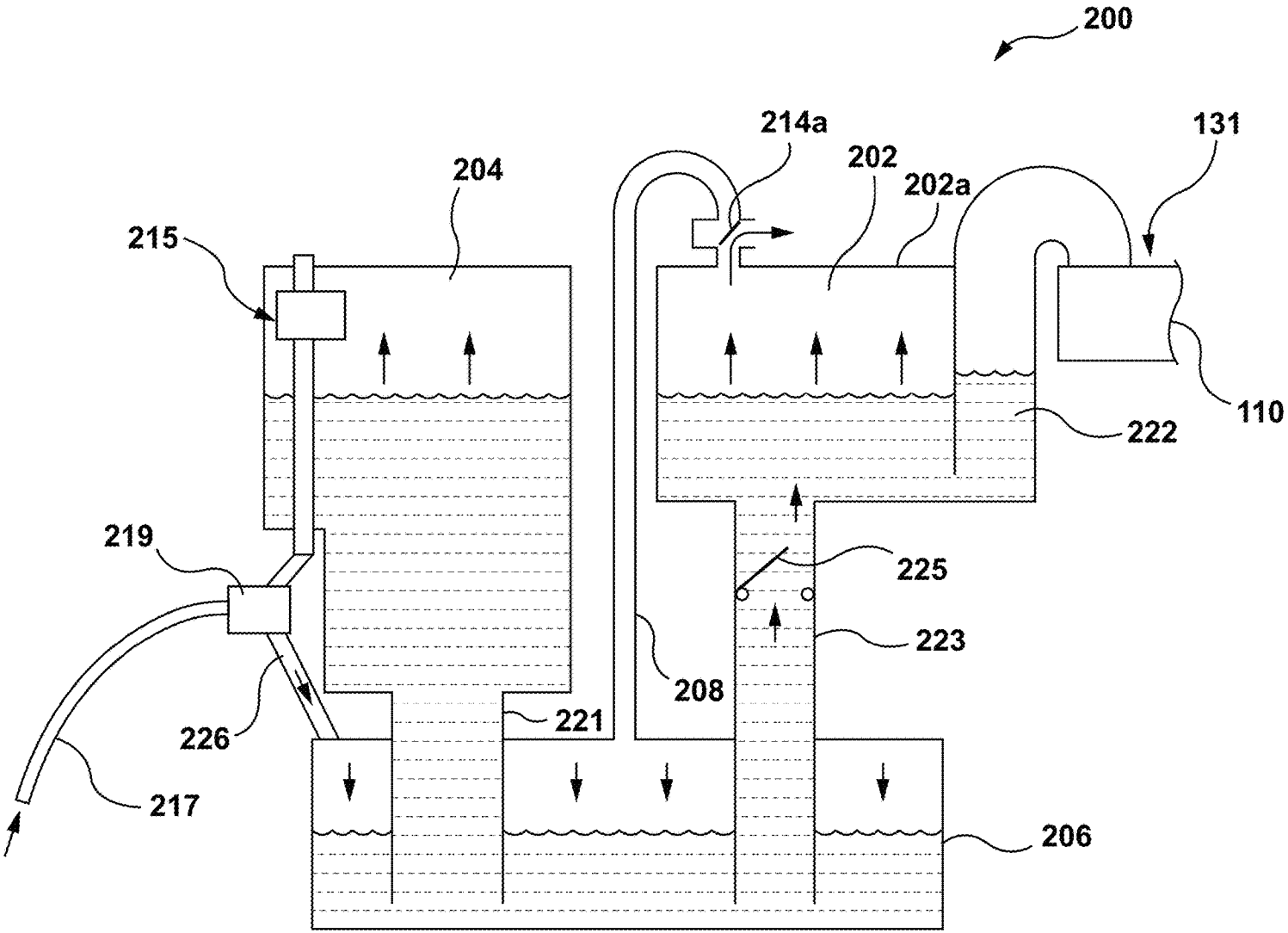
FIG. 7 is a cross-sectional view of the flush system in FIG. 5.

The conduit 223 may include a check valve 225 configured to be selectively open when the flush system 200 is in a fill mode as illustrated in FIG. 7 to allow the water from the third enclosed container 206 to flow up to the first enclosed container 202, or closed when the flush system 200 is in a stand-by mode as illustrated in FIG. 5 and a flush mode as illustrated in FIG. 6 to allow the first enclosed container 202 to retain the water. The check valve 225 may be controlled by the air pressure generated from the air pump (opens check valve) and falling water in conduit 223 during the flush (closes check valve). For example, when air is pumped into the third enclosed container 206, the air forces the water in the third enclosed container 206 to raise up via conduit 223 and into first enclosed container 202. The rising water opens the check valve 225. During this time (filling phase) the air/flush valve 214 is closed, but the bypass exhaust port 214*a* is open, so the air held within 202 can be exhausted as the first enclosed container 202 fills. Once the fill cycle stops and the air pumps stops, the water in the conduit 223 and first enclosed container 202 cannot fall because of the pressure exerted on third enclosed container 106. The water and air in system 200 is stabilized in the standby mode. Once the air/flush valve 214 is activated and the bypass exhaust port 214*a* is closed, air immediately flows to the first enclosed container 202 via conduit 208 and exerts pressure onto the water held within (pressure equals $H_2$). When the flush is activated, the check valve 225 closes from the weight of the water trying to fall down conduit 223. The check valve 225 closes to prevent water held in the first enclosed container 202 from falling back down into the lower container 106 during the flush and instead ensures the water will flow to the toilet bowl rim 131.

In some examples, the flush system 200 may also include one or more conduits 208 to provide fluid communication, such as gas or air, between the third enclosed container 206 and the first enclosed container 202. In the example of FIGS. 5-8, one end of the conduit 208 connects to the top surface 206*a* of the third enclosed container 206, the other end of the conduit 208 connects to the top surface 202*a* of the first enclosed container 202.

The conduit 208 may include an air/flush valve 214 on the conduits 208, for example close to the end connected to the first enclosed container 202. The air/flush valve 214 is configured to be selectively in a close state when the flush system 200 is a standby mode as illustrated in FIG. 5, or an open state when the flush system 200 is in a flush mode as illustrated in FIG. 6, or bypass state when the flush system 200 is in a fill mode as illustrated in FIG. 7.

In the flush mode, when a user pull a handle or press a button connected to the air/flush valve 214, the air/flush valve 214 is configured to open. When the air/flush valve 214 is opened, the compressed air flows into the first enclosed container 202 from the third enclosed container 206 via the conduit 208 and air/flush valve 214, due to the head pressure generated on the top surface of the water in the first enclosed container 202, the water stored therein is discharged to the toilet bowl 110 via the conduit 222 with a greater speed than without the pressure on water. In the example of FIGS. 5-8, the water in the first enclosed container 202 is discharged to the conduit 222 close to the bottom surface 202*b* of the first enclosed container 202 to the rim channel 131 of the toilet bowl 110.

In the flush mode, the amount of head pressure P2 applied to the water in the first enclosed container 202 depends on the height $H_2$ between the water level in the second container 204 and the pressure of the compressed gas or air P1 held in the third enclosed container 206. The head pressure P2 exerted on the water held in the first enclosed container 202 is $P=P1+\rho H_2 g$, as described above.

In the flush mode, the head pressure created from the displacement of pressurized air from the third enclosed container 206 into the first enclosed container 202 increases the velocity of the water forced out of the first enclosed container 202 into the toilet bowl 110, resulting in an improved toilet flushing performance with a reduced volume of water, and the flush is quiet and consistent.

In the flush mode, the compressed air from third enclosed container 206 presses the water stored in the first enclosed container 202 to move to the object through the conduit 202*a*, to the jet and rim channels 131 of the toilet bowl 110, displacing the contents of the toilet bowl 110 into the trapway 132 while generating a very strong siphon.

In the example of FIGS. 5-8, the water in the first enclosed container 202 is discharged to the conduit 222 close to the bottom surface 202*b* of the first enclosed container 202 to the rim channel 131 of the toilet bowl 110.

After the flush mode is complete, the water in the first enclosed container 202 is substantially discharged to flush the toilet bowl 110 via the conduit 202*a*. The flush system 200 is configured to refill the fluid or water in a fill mode. In the fill mode, the fill valve 215 is configured to be opened, the water from the water supply 217 flows into the second container 204, and the water further flows into the third enclosed container 206 via the conduit 221. In some examples, the fill valve 215 may be controlled in the same manner as in a standard toilet, such as by using with a float mechanism. As illustrated in FIG. 7, in the fill mode, the check valve 225 is configured to be opened, so that the water in the third enclosed container 206 flows up into the first enclosed container 202. In the fill mode, the air/flush valve 214 is in a bypass state. In the bypass state, the air/flush valve 214 is closed so that the pressure air stays in the third enclosed container 206, and the exhaust port 214*a* is open to discharge any surplus gas in the first enclosed container 202 during the water fill process in the fill mode. Discharging the gas in the first enclosed container 202 allows the water to replace the gas in the first enclosed container 202 and allows the water to be fully filled in the first enclosed container 202. The exhaust port 214*a* is configured to be closed after the water is filled to a predetermined level after or when the fill mode is complete.

In the fill mode, the third enclosed container 206 is configured to receive compressed gas or air injected via the conduit 226, such as from a gas pump. The compressed gas is injected into the third enclosed container 206 until the pressure of the compressed gas in the third enclosed container 206 is equal to the pressure generated by water in the first and second enclosed containers 202 and 204 on the water surface 206*c* of the third enclosed container 206.

As illustrated in the example of FIG. 5, after completion of the fill mode, the flush system 200 is in a stand-by mode. In the stand-by mode, the water is substantially full in the second container 204 and the first enclosed container 202, the water level in the second container 204 and the first enclosed container 202 is substantially the same. The check valve 225 is configured to be closed for the first enclosed container 202 to retain the water stored therein. The air/flush valve 214 is configured to be closed in stand-by mode and the water in the first enclosed container 202 is not subject to the pressure of the compressed gas in the third enclosed container 206. The compressed gas within the third enclosed container 206 has a pressure equal to the pressure on the surface 206*c* of the water in the third enclosed container 206 in stand-by mode.

In some examples, when the flush system 200 is used in a toilet system by connecting the conduit 222 to the toilet bowl rim channel 131.

Figure 8:
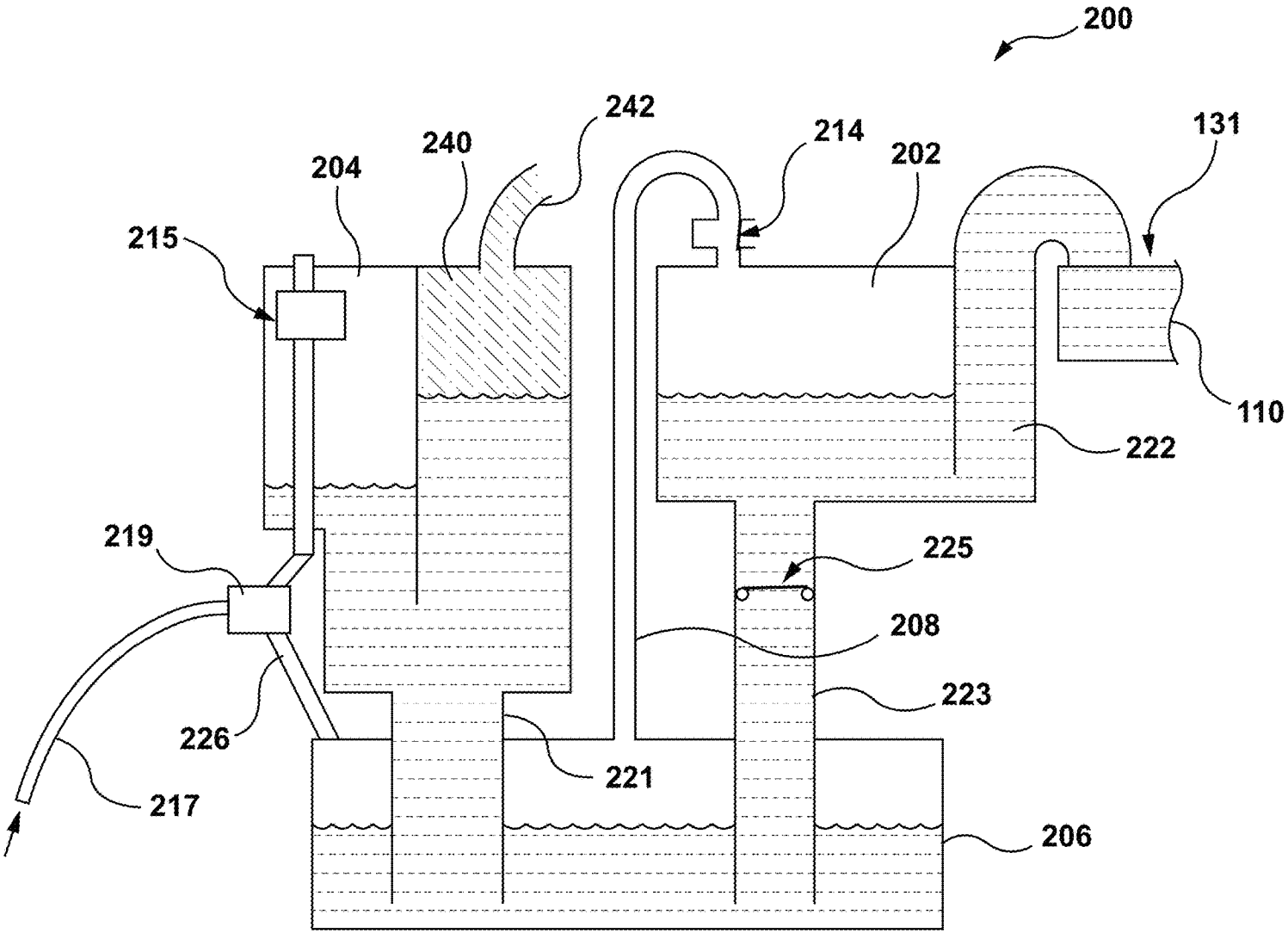
FIG. 8 is a cross-sectional view of the flush system in FIG. 5.

In the embodiment in FIG. 8, the second container 204 further includes a vacuum container 240 placed within the second container 204. The bottom of the vacuum container 240 is open and placed above the bottom surface 204*a* of the second container 204 and below the top surface 204*c* of the water in the second container 204. The vacuum container 240 has one or more conduits 242 with one end connected at the top surface 204*b*, and the other end configured to connect to the top of the toilet bowl's trapway (not shown). In the fill mode, as water raises in the second container 204 and vacuum container 240 air originally held in the vacuum container is transferred to the toilet bowl trapway via conduit 242. This air is used to pressurize the trapway. In the flush mode, the air held in the toilet bowl trapway is pulled back into the vacuum container 240, which in turn creates a vacuum or pulling action on the contents or object—toilet bowl. This action helps to start the siphon action and increases overall performance of the toilet.

Figure 9A:
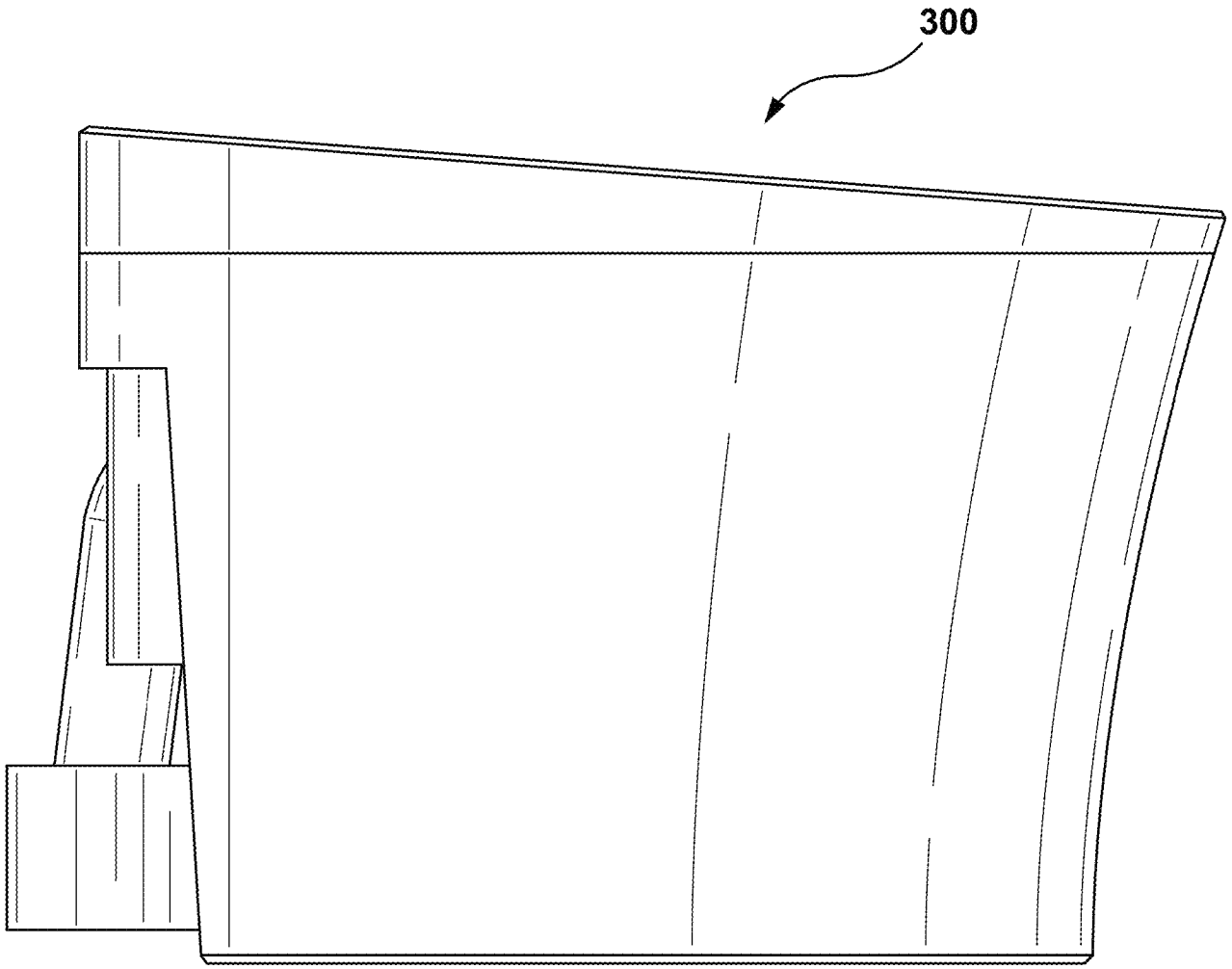
FIG. 9A is a side perspective view of a toilet system, according to an embodiment of the present disclosure.
Figure 9B:
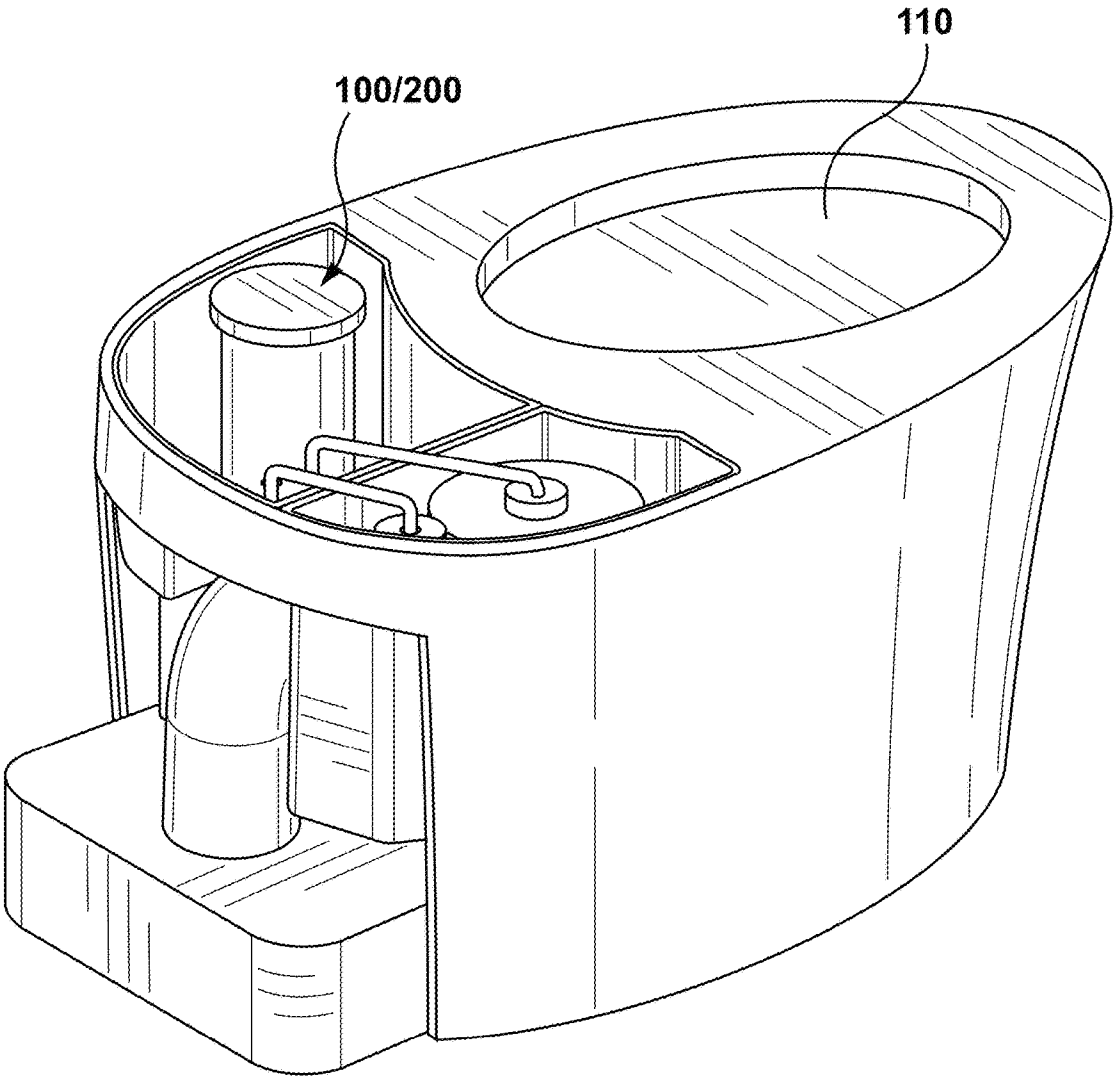
FIG. 9B is a top perspective view of the toilet system in FIG. 9A, with the top lid removed.

With the configuration of the flush system 200, due to the head pressure created by the second container 204 and the third enclosed container 206, the first enclosed container 202 may be mounted at the substantially the same height as the toilet bowl 110 while generating sufficient pressure on the water to flush the toilet bowl 110 with improved flush performance, and the resulting flush is quiet and consistent. For example, as illustrated in the example of FIGS. 9A-9B, the top surface 202*a* of the first enclosed container 202 has substantially the same height as the top surface of the toilet bowl 110. Accordingly, the toilet system mounted with the flush system 200 may have a low profile or tankless toilet system.

FIGS. 9A and 9B illustrate an example of a toilet system 300 incorporating the flush system 100 or 200. As illustrated in the example of FIGS. 9A and 9B, the toilet system 300 mounted with the flush system 100 or 200 has a low profile or is tankless toilet system, and the top surfaces of the first enclosed container 102 or 202 and the second container 104 or 204 have substantially the same height as the top surface of the toilet bowl 110.

In the present disclosure, the first enclosed container 102 or 202 and the second container 104 or 204, the third enclosed container 106 or 206, and the one or more conduits 108, 208, 123, 217, 223, and/or 226 can be made from suitable materials, such as PVC, ceramic, Porcelain, and/or metal.

In the present disclosure, conduits, such as 223, 221/123, are configured to be adequately sized to allow the flow and transfer of water between the various containers without hindrance. In some examples, the conduits 223, 221/123 may surpass 25 mm in diameter, but less than 100 mm. The conduits such as 108 and 208 can be much smaller in diameter, such as 30 mm or less since they are used for the transfer of air between the containers.

Certain adaptations and modifications of the described embodiments can be made. Therefore, the above discussed embodiments are considered to be illustrative and not restrictive.

What is claimed is:

1. A flush system for flushing an object, comprising:

a first enclosed container for storing liquid to flush the object;

a second container for filling liquid from a source; and a third enclosed container at least partially below each of the first enclosed container and the second container, the third enclosed container configured to contain liquid and gas and to be in fluid communication with each of the first enclosed container and the second container, and the first enclosed container and the second container configured to be in liquid communication via the third enclosed container, wherein the gas in the third enclosed container is configured to exert a head pressure, via one or more conduits, to the liquid in the first enclosed container to flush the object.

2. The flush system of claim 1, wherein the object is a toilet bowl.

3. The flush system of claim 1, wherein the second container is at least partially open to atmosphere.

4. The flush system of claim 1, wherein the flush system is configured to remain up to or more than 5" of water column pressure between a first top surface water level at the second container and a second top surface water level at the third enclosed container at an end of flush.

5. The flush system of claim 1, wherein a bottom surface of the first enclosed container or the second container is higher than a top surface of the third enclosed container.

6. The flush system of claim 2, wherein the first enclosed container is placed substantially at a same level as a top rim of the toilet bowl.

7. The flush system of claim 3, wherein the head pressure is generated from the atmosphere and the liquid in the second container.

8. The flush system of claim 7, wherein the gas in the third enclosed container exerts the head pressure to the liquid in the first enclosed container via one or more conduits.

9. The flush system of claim 3, wherein the second container is in fluid communication with the third enclosed container via one or more conduits.

10. The flush system of claim 1, wherein the first enclosed container comprises a flush valve.

11. The flush system of claim 1, wherein the head pressure is generated from a compressed gas injected into the third enclosed container and the liquid in the second container.

12. The flush system of claim 1, wherein the first enclosed container is in fluid communication with the third enclosed container via one or more conduits, the one or more conduits comprising a check valve configured to selectively open or close the fluid communication.

13. The flush system of claim 12, wherein the third enclosed container is configured to inject compressed gas in the first enclosed container via one or more conduits.

14. The flush system of claim 13, further comprising a gas valve on the one or more conduits for selectively open and close gas injection to the first enclosed container from the third enclosed container.

15. The flush system of claim 1, wherein the liquid is water, and the gas is air.

16. The flush system of claim 3, wherein a top surface of the second container and a top surface of the first enclosed container are approximately 15 to 18 inches above a top surface of the third enclosed container.

17. The flush system of claim 14, wherein the flush system is in a stand-by mode, a flush mode, or a fill mode.

18. A toilet system, comprising:

a toilet bowl;

a first enclosed container in fluid communication with the toilet bowl, the first enclosed container configured for storing liquid to flush the toilet bowl;

a second containers configured for receiving liquid from a source; and a third enclosed container at least partially below each of the first enclosed container and the second container, the third enclosed container configured to contain liquid and gas, and to be in fluid communication with each of the first enclosed container and the second container, and the first enclosed container and the second container configured to be in liquid communication via the third enclosed container, wherein the gas in the third enclosed container is configured to exert a head pressure, via one or more conduits, to the liquid in the first enclosed container to flush the toilet bowl.

19. A method for flushing a toilet bowl, comprising:

storing liquid to flush the toilet bowl in a first enclosed container in fluid communication with the toilet bowl;

receiving liquid from a source in a second containers; and exerting a head pressure to gas store in a third enclosed container, via one or more conduits, to the liquid in the first enclosed container to flush the toilet bowl, wherein the third enclosed container configured to contain liquid and gas, and to be in fluid communication with each of the first enclosed container and the second container, and the first enclosed container and the second container configured to be in liquid communication via the third enclosed container.

20. The toilet system of claim 18, wherein the first enclosed container has a volume substantially close or equal to a flush volume of the toilet bowl.

* * * * *